United States Patent [19]

Van Straaten

[11] Patent Number: 5,046,726

[45] Date of Patent: Sep. 10, 1991

[54] EXERCISER

[75] Inventor: Willem J. Van Straaten, Transvaal, South Africa

[73] Assignee: Verimark Close Corporation, Transvaal, South Africa

[21] Appl. No.: 480,122

[22] Filed: Feb. 14, 1990

[30] Foreign Application Priority Data

Feb. 1, 1990 [ZA] South Africa ..... 90/0762

[51] Int. Cl.[5] ..... A63B 21/05

[52] U.S. Cl. ..... 272/141; 272/137

[58] Field of Search ..... 272/135–142

[56] References Cited

U.S. PATENT DOCUMENTS

| | | | |
|---|---|---|---|
| 1,023,756 | 4/1912 | Pons | 272/141 |
| 3,132,861 | 5/1964 | Horney | 272/140 X |
| 3,633,908 | 1/1972 | Kraoth | 272/141 X |
| 4,193,593 | 3/1980 | Wilson | 272/137 |
| 4,351,527 | 9/1982 | Crisp, Jr. | 272/137 |
| 4,489,937 | 12/1984 | Kong | 272/137 |
| 4,856,776 | 8/1989 | Ching-Liang | 272/142 |
| 4,863,162 | 9/1989 | Neckamm et al. | 272/137 |

FOREIGN PATENT DOCUMENTS

| | | | |
|---|---|---|---|
| 1012574 | 6/1977 | Canada | 272/141 |
| 308472 | 2/1969 | Sweden | 272/141 |

*Primary Examiner*—Robert Bahr

*Attorney, Agent, or Firm*—Burns, Doane, Swecker & Mathis

[57] ABSTRACT

An exerciser comprises a tube, a spring in the tube, a plunger reciprocable in the tube, handles on the plunger and transverse supports extending from the bottom of the tube for comfortably resting against the thighs or in the lap of a user. Stomach muscles are exercised by grasping the handles with the transverse supports on the thighs and applying a pumping action to the plunger.

4 Claims, 2 Drawing Sheets

EXERCISER

BACKGROUND TO THE INVENTION

This invention relates to a stomach muscle exerciser.

As far as the applicant is aware there is no simple and relatively cheap apparatus available for exercising the stomach muscles. Most devices for this purpose place strains on the skeleton and on muscles other than stomach muscles.

SUMMARY OF THE INVENTION

An exerciser according to the invention comprises an axially compressible strut, transverse handles at one end of the strut and at the other end of the strut support means for comfortably resting against the thighs or in the lap of a user.

In one form of the invention the support means also extends transversely to the strut and the handles can preferably be twisted relatively to the support means.

The invention further provides that the strut may be composed of a tube, a plunger reciprocable in the tube and a spring positioned in the tube and compressible by the plunger.

DESCRIPTION OF EMBODIMENTS

Figure 1:
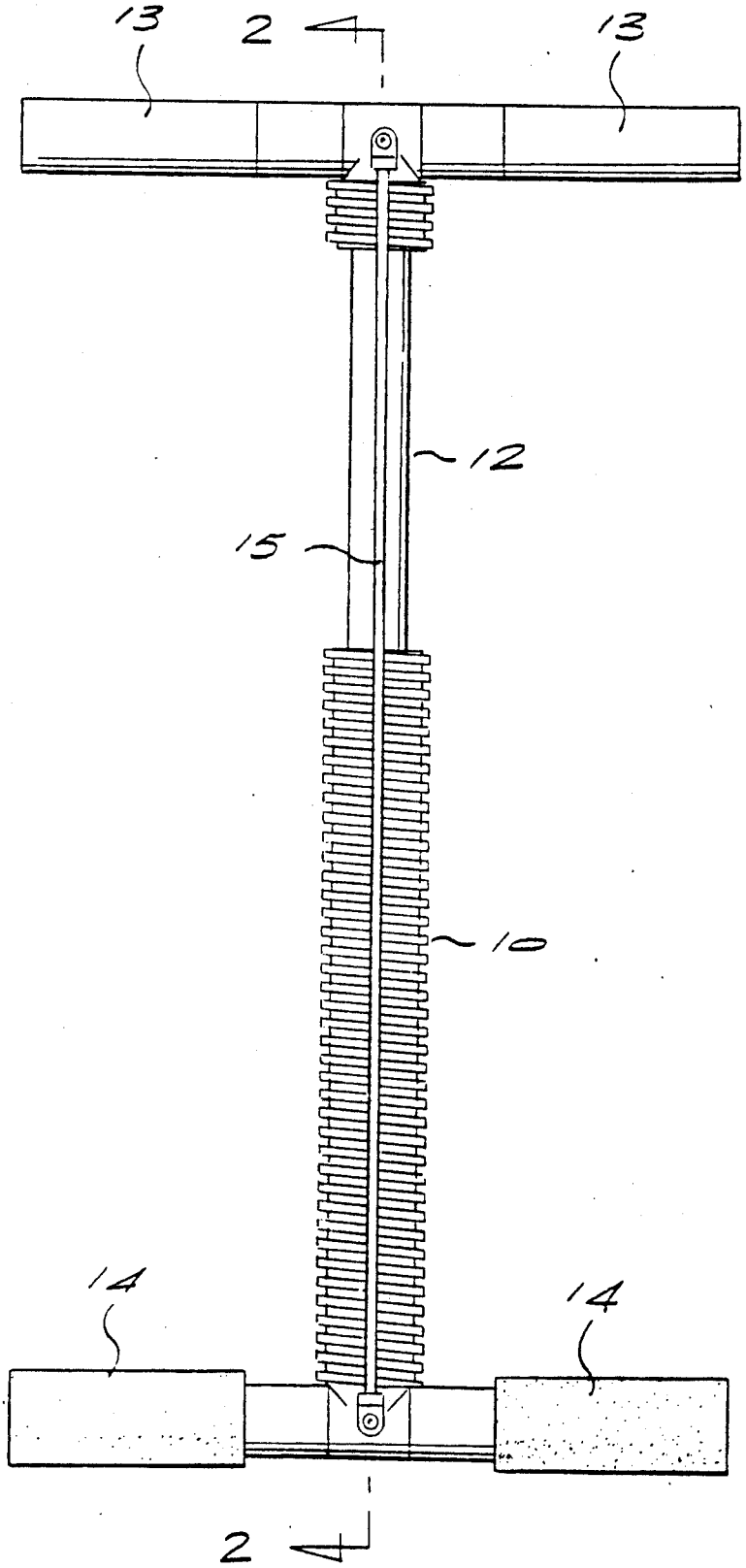
FIG. 1 is a front view of an exerciser.
Figure 2:
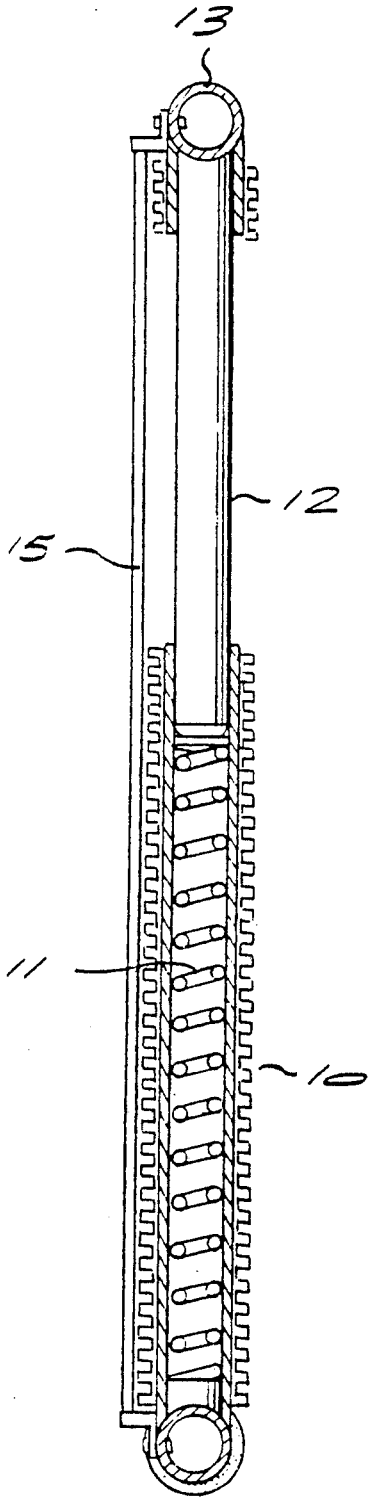
FIG. 2 is a section on the line 2—2 in FIG. 1.

The illustrated exerciser has a strut comprising a tube 10 housing a compression spring 11, and a plunger 12 which can move down the tube 10 to compress the spring 11. At the top of the plunger 12 there are a pair of transverse handles 13 which are rubber covered for convenient grasping by a user. At the lower end of the strut there is a support composed of a pair of transverse arms 14 which are covered by sponge rubber sleeves. An elastic band 15 holds the parts in the illustrated position, but can be stretched to withdraw the plunger 12 for removal and replacement of the spring 11.

In practice the apparatus is supplied with a variety of springs 11 with different stiffnesses, say with three, for different users and for increasing resistance with progress.

During exercising the user presses the arms 14 against his thighs, grasps the handles 13 and performs a pumping action on the strut.

Figure 3:
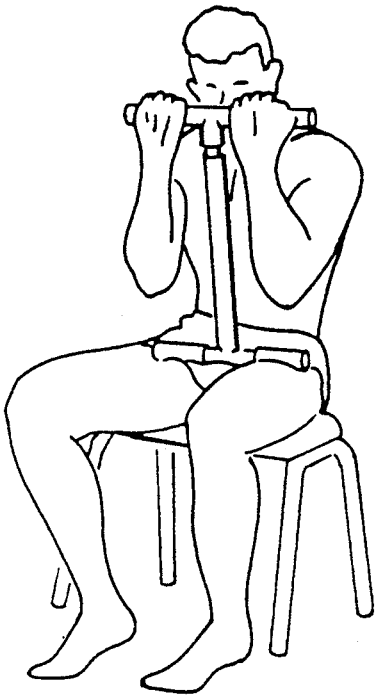
FIGS. 3, 4, 5 and 6 illustrate the use of the exerciser.
Figure 4:
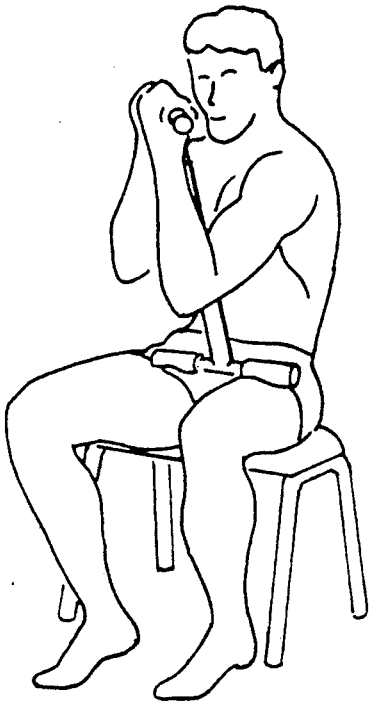
Figure 5:
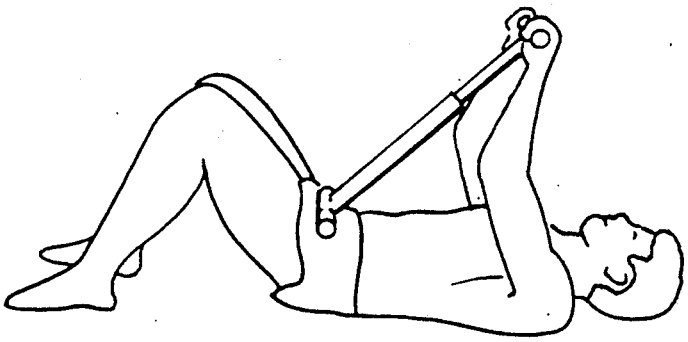
Figure 6:
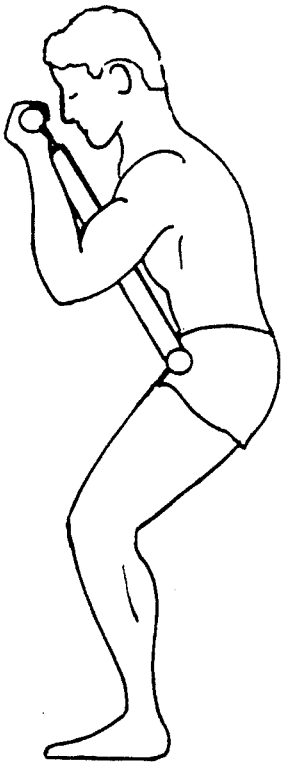

This may be done sitting down as shown in FIG. 3. Also by twisting the handles 13 as shown in FIG. 4, different stomach muscles can be exercised. Exercises can also be performed while lying down (FIG. 5) or standing up in a slightly crouched position (FIG. 6).

The exerciser is reasonably inexpensive yet very effective for exercising those stomach muscles which are the bane of many modern people.

I claim:

1. An exercising device comprising:

a strut comprising first and second telescoping members, the first member having a first end and a second end, said second member arranged telescopically with the first member, the second member being of tubular form with an open first end and a closed second end, the first end of the first member being axially slidable within the second member and being capable of withdrawal through the first end of the second member, the first and second members including first and second transverse elements, respectively, the first transverse element extending transversely across the second end of the first member, the second transverse element extending transversely across the second end of the second member, one of the first and second elements defining handles at opposite ends thereof, and the other of the first and second elements having padded ends for resting comfortably against the thighs or lap of a user, a compression spring removably located in the second member between the first end of the first member and the second end of the second member, whereby axial movement of the first member into the second member compresses the spring; and an elastic cord interconnecting the first and second members for yieldably biasing the first and second members together in their telescopic relationship, the elastic cord being elastically stretchable sufficiently to permit the first end of the first member to be removed from the first end of the second member to permit replacement of the spring.

2. An exercising device according to claim 1, wherein the elastic cord has opposite ends attached to the first and second transverse elements, respectively.

3. An exercising device according to claim 1, wherein the elastic band is situated to the outside of the first and second members.

4. An exercising device according to claim 1 including an additional spring having a different spring characteristic than the first-named spring and which is interchangeable with the first-named spring when the first member is removed from the second member.

* * * * *